US010850144B2

(12) United States Patent
Meyer et al.

(10) Patent No.: US 10,850,144 B2
(45) Date of Patent: Dec. 1, 2020

(54) PREACTION SPRINKLER VALVE ASSEMBLIES, RELATED DRY SPRINKLER DEVICES, AND COMPRESSIVE ACTIVATION MECHANISM

(71) Applicant: Globe Fire Sprinkler Corporation, Standish, MI (US)

(72) Inventors: Stephen J. Meyer, Chester Springs, PA (US); Thomas Edwin Archibald, Midland, MI (US); Kevin Desmond Maughan, North Kingstown, RI (US); Yoram Ringer, Providence, RI (US); John Desrosier, Plymouth, MA (US)

(73) Assignee: VICTAULIC COMPANY, Easton, PA (US)

( * ) Notice: Subject to any disclaimer, the term of this patent is extended or adjusted under 35 U.S.C. 154(b) by 73 days.

(21) Appl. No.: 15/623,048

(22) Filed: Jun. 14, 2017

(65) Prior Publication Data

US 2018/0361182 A1 Dec. 20, 2018

(51) Int. Cl.
*A62C 35/68* (2006.01)
*A62C 37/12* (2006.01)
(Continued)

(52) U.S. Cl.
CPC ..... *A62C 35/68* (2013.01); *A62C 37/12* (2013.01); *A62C 37/42* (2013.01); *A62C 3/004* (2013.01)

(58) Field of Classification Search
CPC ..... A62C 35/68; A62C 37/12; A62C 37/42; A62C 3/004; A62C 3/002;
(Continued)

(56) References Cited

U.S. PATENT DOCUMENTS 1,182,460 A 5/1916 Cruger
2,251,422 A 8/1941 Rider
(Continued)

FOREIGN PATENT DOCUMENTS

CN 103845836 A 6/2014
DE 20209353 U1 11/2002
(Continued)

OTHER PUBLICATIONS

Int'l Search Report and Written Opinion dated Nov. 15, 2016 in Int'l Application No. PCT/US2016/044569.
(Continued)

*Primary Examiner* — Arthur O. Hall
*Assistant Examiner* — Juan C Barrera
(74) *Attorney, Agent, or Firm* — Panitch Schwarze Belisario & Nadel LLP

(57) ABSTRACT

A thermal trigger assembly for remote mechanical actuation of another fire protection system component includes an activation component with a distal base, a distal movable member, a proximal base, a proximal movable member, and a bias member biasing the proximal movable member from a preactivation position to an activated position located proximally of the preactivation position. A thermally responsive element is retained by the distal base, loses structural integrity under occurrence of a predetermined thermodynamic condition, and thereby allows the distal movable member to move from a preactivation position to an activated position with respect to the distal base. A flexible connector connects the proximal movable member to the distal movable member. Upon the loss of structural integrity by the thermally responsive element, a biasing force from the bias member causes a movement of the proximal movable member from the preactivation position to the activated position.

27 Claims, 10 Drawing Sheets

(51) Int. Cl.
*A62C 37/42* (2006.01)
*A62C 3/00* (2006.01)

(58) Field of Classification Search
CPC ..... A62C 31/00–28; A62C 35/00–68; Y10T 137/1963
USPC ..... 169/17, 19; 137/79; 251/294
See application file for complete search history.

(56) References Cited

U.S. PATENT DOCUMENTS

| | | | |
|---|---|---|---|
| 2,506,468 | A | 5/1950 | Rider |
| 2,865,225 | A | 12/1958 | Huffman |
| 3,309,028 | A | 3/1967 | Zieg |
| 3,392,787 | A | 7/1968 | Weise |
| 3,419,083 | A | 12/1968 | Cholin et al. |
| 3,463,235 | A | 8/1969 | Flajole |
| 3,463,236 | A | 8/1969 | Flajole |
| 3,616,860 | A | 11/1971 | Willms |
| 3,657,942 | A | 4/1972 | Sullivan |
| 3,684,023 | A | 8/1972 | Champagne |
| 3,722,596 | A | 3/1973 | Livingston |
| 3,734,191 | A | 5/1973 | Johnson et al. |
| 3,768,567 | A | 10/1973 | Weise |
| 3,779,318 | A | 12/1973 | Livingston |
| 3,911,940 | A | 10/1975 | Johnson |
| 3,924,687 | A | 12/1975 | Groos |
| 3,991,829 | A | 11/1976 | Johnson |
| 4,046,406 | A | 9/1977 | Press et al. |
| 4,082,148 | A | 4/1978 | Willms |
| 4,128,128 | A | 12/1978 | Mears |
| 4,201,014 | A | 5/1980 | Hess |
| 4,220,208 | A | 9/1980 | Jackson et al. |
| 4,258,795 | A | 3/1981 | Hansen |
| 4,368,782 | A | 1/1983 | Bray |
| 4,553,602 | A | 11/1985 | Pieczykolan |
| 4,854,388 | A | 8/1989 | Wyatt |
| 4,951,755 | A | 8/1990 | Barnett et al. |
| 4,976,320 | A | 12/1990 | Polan |
| 5,127,479 | A | 7/1992 | Stehling et al. |
| 5,188,184 | A | 2/1993 | Northill |
| 5,295,503 | A | 3/1994 | Meyer et al. |
| 5,396,959 | A | 3/1995 | Macdonald |
| 5,415,239 | A | 5/1995 | Kotter et al. |
| 5,533,576 | A | 7/1996 | Mears |
| 5,609,211 | A | 3/1997 | Meyer et al. |
| 5,669,449 | A | 9/1997 | Polan et al. |
| 5,775,431 | A | 7/1998 | Ondracek |
| 5,967,240 | A | 10/1999 | Ondracek |
| 6,029,749 | A | 2/2000 | Reilly et al. |
| 6,158,519 | A | 12/2000 | Kretschmer |
| 6,666,277 | B2 | 12/2003 | Reilly |
| 6,691,790 | B1 | 2/2004 | MacDonald, III et al. |
| 6,851,482 | B2 | 2/2005 | Dolan |
| 7,032,681 | B1 | 4/2006 | Sprakel |
| 7,055,612 | B2 | 6/2006 | Jackson et al. |
| 7,104,333 | B2 | 9/2006 | Ringer |
| 7,143,834 | B2 | 12/2006 | Dolan |
| 7,185,711 | B2 | 3/2007 | Jackson et al. |
| 7,322,423 | B2 | 1/2008 | Ringer |
| 7,353,881 | B2 | 4/2008 | Akins et al. |
| 7,373,720 | B1 | 5/2008 | Jensen et al. |
| 7,543,653 | B2 | 6/2009 | Reilly et al. |
| 7,823,650 | B2 | 11/2010 | Eckholm et al. |
| 7,921,928 | B2 | 4/2011 | Thompson et al. |
| 8,083,002 | B1 | 12/2011 | Golinveaux et al. |
| 8,528,653 | B1 | 9/2013 | Silva, Jr. et al. |
| 8,584,767 | B2 | 11/2013 | Johnson et al. |
| 8,746,358 | B2 | 6/2014 | Alchalel et al. |
| 8,800,673 | B2 | 8/2014 | Multer et al. |
| 8,844,554 | B2 | 9/2014 | Kikuchi et al. |
| 8,887,822 | B2 | 11/2014 | Polan |
| 8,973,672 | B2 | 3/2015 | Fraederich |
| 9,121,521 | B2 | 9/2015 | Girouard |
| 9,339,673 | B2 | 5/2016 | Shipman |
| 9,345,918 | B2 | 5/2016 | Bucher et al. |
| 9,358,411 | B2 | 6/2016 | Shipman |
| 9,395,918 | B2 | 7/2016 | Ho et al. |
| 9,415,250 | B2 | 8/2016 | Bucher et al. |
| 9,415,256 | B2 | 8/2016 | Inzer |
| 9,901,763 | B2 | 2/2018 | Meyer et al. |
| 2003/0075343 | A1 | 4/2003 | Ballard |
| 2003/0132009 | A1 | 7/2003 | Thompson |
| 2004/0123989 | A1 | 7/2004 | Sprakel et al. |
| 2005/0121206 | A1 | 6/2005 | Dolan |
| 2007/0000671 | A1 | 1/2007 | Reilly et al. |
| 2007/0007020 | A1 | 1/2007 | Chase |
| 2007/0221388 | A1 | 9/2007 | Johnson |
| 2007/0267202 | A1 | 11/2007 | Mariller |
| 2010/0038099 | A1 | 2/2010 | Thompson et al. |
| 2011/0024138 | A1 | 2/2011 | Multer et al. |
| 2011/0214888 | A1 | 9/2011 | Alchalel et al. |
| 2012/0031630 | A1 | 2/2012 | Stephens |
| 2012/0199764 | A1* | 8/2012 | Girouard ..... F16K 17/38 251/11 |
| 2012/0298383 | A1* | 11/2012 | Shipman ..... A62C 37/11 169/37 |
| 2013/0037281 | A1 | 2/2013 | Szentimrey et al. |
| 2013/0199803 | A1 | 8/2013 | Multer |
| 2013/0319696 | A1* | 12/2013 | Polan ..... A62C 31/02 169/17 |
| 2015/0060091 | A1 | 3/2015 | Polan |
| 2015/0075821 | A1 | 3/2015 | Bucher et al. |
| 2015/0121206 | A1 | 4/2015 | Odonoghue et al. |
| 2017/0028238 | A1* | 2/2017 | Meyer ..... A62C 37/11 |
| 2017/0340911 | A1 | 11/2017 | Meyer et al. |
| 2018/0043198 | A1 | 2/2018 | Meyer et al. |
| 2018/0361182 | A1 | 12/2018 | Meyer et al. |

FOREIGN PATENT DOCUMENTS

| | | | |
|---|---|---|---|
| JP | S50083097 | U | 7/1975 |
| JP | S51117500 | U | 9/1976 |
| JP | 2000153005 | A | 6/2000 |
| JP | 2001340485 | A | 12/2001 |
| JP | 2003164543 | A | 6/2003 |
| KR | 101259098 | B1 | 5/2013 |
| WO | 2009108944 | A2 | 9/2009 |
| WO | 2017019904 | A1 | 2/2017 |
| WO | 2017075070 | A1 | 5/2017 |

OTHER PUBLICATIONS

Int'l Search Report and Written Opinion dated Feb. 24, 2017 in Int'l Application No. PCT/US2016/066979.

Series MJC Multiple Jet Controls DN20, DN25, DN50, 12 Bar BSPT Inlet & Outlets Threads, TYCO Fire Products Data Sheet, Oct. 2014, downloaded from web page: http://www.tyco-fire.com/TD_TFP/TFP/TFP1346_10_2014.pdf, Download Date: May 24, 2016, original posting date: uknown, 10 pages.

Wilkins, "The Use of Specific Application Sprinklers for Protecting Attics", Tyco Fire & Building Products, pp. 1-92 (Oct. 21, 2007).

U.S. Appl. No. 62/246,561, filed Oct. 26, 2015.

Int'l Preliminary Report on Patentability dated Jan. 30, 2018 in Int'l Application No. PCT/US2016/044569.

Int'l Preliminary Report on Patentability dated Jun. 19, 2018 in Int'l Application No. PCT/US2016/066979.

Int'l Search Report and Written Opinion dated Jul. 27, 2018 in Int'l Application No. PCT/US2018/034148.

Office Action dated Jul. 9, 2018 in U.S. Appl. No. 15/380,605, by Meyer.

Examination Report dated Feb. 14, 2020 in Australian Application No. 2018286522.

Office Action dated Sep. 11, 2020 in Chinese Application No. 201880039988.9.

* cited by examiner

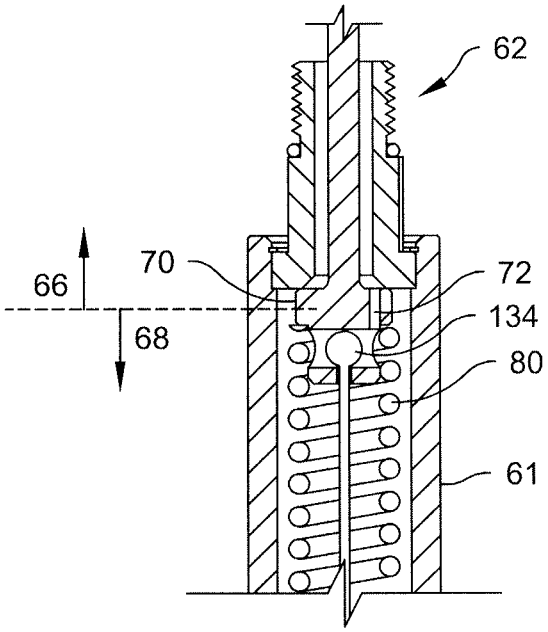
*Fig. 9*
*Fig. 10*
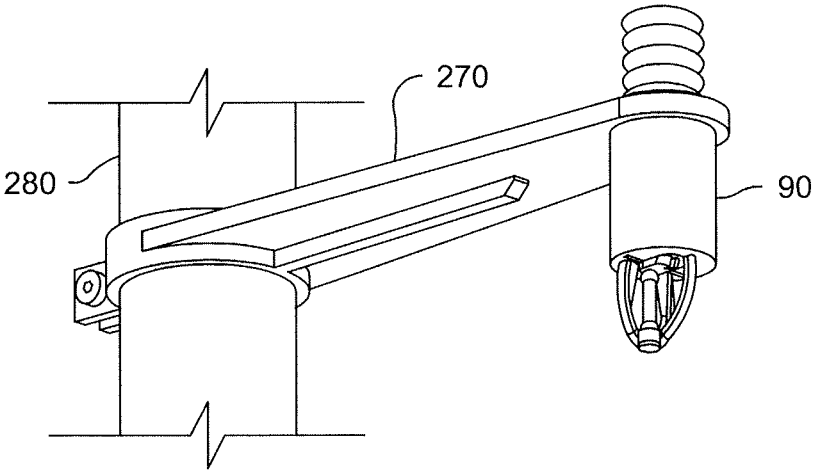

PREACTION SPRINKLER VALVE ASSEMBLIES, RELATED DRY SPRINKLER DEVICES, AND COMPRESSIVE ACTIVATION MECHANISM

BACKGROUND OF THE INVENTION

The present invention relates generally to fire protection, and, more particularly, to activation components for fire protection systems, and valves for use in fire protection systems.

Fire sprinkler system installation and operation are subject to nationally recognized codes.

As is aptly pointed out in U.S. Patent Application Publication No. 2013/0199803, dry sprinklers are used in areas that are or may be exposed to freezing conditions, such as in freezers, unheated internal areas, walkways, etc. In typical dry-pipe systems, supply conduits run in a space where the water in the supply conduit is not subject to freezing. A dry sprinkler is attached to such supply conduit and extends into a space where the water would otherwise be subject to freezing.

As Publication No. 2013/0199803 further points out, the typical construction of a dry sprinkler comprises a tube ("drop") with a pipe connector at the inlet end of the tube (for connecting the inlet end to the supply pipe network of the fire suppression system), a seal member at the inlet end to prevent water from entering the tube prior to activation such as in the case of a fire, and a mechanism to maintain the seal at the inlet end until the sprinkler is activated. Typically, a nozzle with an outlet and a deflector is attached to the opposite, outlet end of the tube. Also, the tube is sometimes vented to the atmosphere to allow drainage of any condensation that may form in the tube. Such dry sprinklers are disclosed, for example, in U.S. Pat. No. 5,775,431. As shown generally in that patent, the actuating mechanism can include a rod or other similar rigid structure that extends through the tube between the nozzle end and the inlet end to maintain a seal at the inlet end. The actuating mechanism further may include a thermally responsive element that supports the rod or the like at the nozzle end and thereby supports the seal at the inlet end. Alternatively, the tube is also sealed at the nozzle end of the tube, and the rod is supported at the nozzle end by the seal member which is itself supported by the thermally responsive support element. In such arrangements, the space in the tube between the two seal members can be pressurized with a gas, such as dry air or nitrogen, or filled with a liquid such as an antifreeze solution. When an elevated temperature is experienced, the thermally responsive support element fails, thereby allowing the rod to move releasing the inlet end seal (and also any outlet seal at the nozzle end of the tube) to allow water from the supply conduit to flow into and through the tube to the nozzle.

The rigid tube or "drop" portion of such conventional dry sprinklers of the type in U.S. Pat. No. 5,775,431 extends with the nozzle into the unheated area from a wet branch line (located in a heated area) and must be precisely aligned and installed while avoiding various architectural, structural, and mechanical obstructions typically found in commercial or industrial buildings. The installer has to first install wet main and branch supply line piping for a sprinkler system and then measure a suitable length for each dry sprinkler from the branch line to the desired height of the nozzle with respect to a ceiling or the like, as the spacing between the branch and the ceiling or desired position of the nozzle is generally not some accurately predetermined distance. Because the actuation rod has to extend between the inlet seal and the nozzle outlet seal or other support at the outlet end, each dry sprinkler like that in U.S. Pat. No. 5,775,431 is custom made for a given length. An installer typically orders dry sprinklers for the installation according to the lengths that are measured to within a fraction (i.e. ⅛) of an inch. Delivery typically takes a minimum of seven to ten business days and, depending upon backlog, can take weeks. This delays installation and completion of construction projects. Longer delays occur if mistakes are made in measuring or fabricating the sprinklers or the sprinklers are damaged in transit and replacement sprinklers required, further delaying completion of the installation.

Some manufacturers have addressed installation difficulties at least by providing dry sprinklers with an integral "flexible" drop tube. U.S. Patent Application Publication No. 2013/0199803 discloses such a "dry" sprinkler. Here, a seal 4 at the inlet end of the drop tube 1 is held in place by pressurized fluid between the seal 4 and a seal 12 at the outlet end of the tube at the sprinkler head. While this arrangement provides some flexibility with respect to installation and fabrication by the installer and manufacturer, the arrangement leaves the end user with a complicated pressure regulation system to maintain to assure that pressure in the flexible tube is held at an adequate level to prevent water leakage through the inlet end seal from the branch supply line.

A different type of dry sprinkler 12 with a flexible drop 14 is disclosed in U.S. Pat. No. 8,887,822. A flexible link 56 is passed through the center of the integral flexible drop 14 between a pivoting valve member such as a clapper 44 and a plug 24 held in the sprinkler outlet of the nozzle 20 by a fusible element 22. The link 56 is sufficiently flexible so as to conform to bending of the flexible drop 14. Activation of the sprinkler by disintegration of the fusible element 22 at the orifice 22 releases the plug 24 and a spring 66 that pulls on one end of the link to remove an opposing end of the link positioned in something called an "X brace valve latch" 54 holding the clapper 44 closed. This sprinkler can be pressurized with appropriate fluid or opened to atmosphere through vent holes 98. However, what is not explained is what assures that the latch 54 will be cleanly released. The latch 54 must slide through the elbow without twisting and remove itself from the path of the clapper 44. Also, internal braces 64 have to be provided at any significant bend of the tube 14 or there is a danger that the flexible link 56 will be allowed to go sufficiently slack so as not to be pulled from the latch when the thermally response element triggers.

U.S. Patent Application Publication No. 2013/0319696 discloses another dry sprinkler 100 with an integral flexible drop tube 3 connecting a threaded inlet 1 and an opposing outlet 2. This is an alternative arrangement to assure that a flexible link 10 extending between an inlet valve assembly 13 and an outlet plug 53 does not go slack from bends in the tube, regardless of where the bends in the tube are located. The sprinkler 100 is activated by collapse of a frangible element 56 retaining the plug 53 and a spacer 45, permitting the spacer 45 to move and pull the link 10, which mechanically fractures a bulb 11 at the inlet end by twisting a collar 36 on the bulb 11. In the one example given in paragraph 38, approximately one-half inch of slack can be taken up by the arrangement.

The designs of dry sprinklers require fabrication precise to within a fraction of an inch of the installed length, even with flexible tubes. Even the dry sprinkler disclosed in U.S. Patent Application Publication No. 2013/0319696 allows only a larger fraction of an inch leeway than the other, previously identified dry sprinklers. As a result, all dry sprinkler tubes must be ordered from and fabricated by a manufacturer, at great expense and time to the installer and end purchaser compared with wet sprinkler system installations.

Although U.S. Patent Application Publication No. 2012/0298383 describes the provision of dry sprinklers with flexible tubes (also known as flexible drops) and weep holes, in practice all or nearly all commercially available, flexible-tube-equipped dry sprinklers are provided with a relatively long flexible tube having an equally long inner tube that keeps a seal assembly closed. Under pressure, there is deformation in the flexible tube, and there have been issues with leakage if the flexible tube is used by itself without an inner tube.

Another disadvantage of the existing flexible drop is that it requires a bracket that has to be connected to the ceiling, so there may be limits to the type of ceiling and structure where the flexible drop can be installed.

If a system enabled installers to fabricate and install, on site, a dry sprinkler equivalent to a wet sprinkler system, without employing custom measured and factory built dry sprinkler assemblies, the system would revolutionize the fire protection industry.

BRIEF SUMMARY OF THE INVENTION

Briefly stated, in a preferred embodiment of the present invention, a thermal trigger assembly is configured for remote mechanical actuation of another fire protection system component. The thermal trigger assembly comprises an activation component. The activation component includes a proximal base having a proximal end and a distal end with respect to the other fire protection system component. A proximal movable member is movable with respect to the proximal base. A bias member is located with respect to the proximal base to bias the proximal movable member from a preactivation position to an activated position with respect to the proximal base, and the activated position is located proximally of the preactivation position. The thermal trigger assembly comprises a distal base, a distal movable member, and a thermally responsive element. The thermally responsive element is retained by the distal base until a predetermined thermodynamic condition occurs. The thermally responsive element is configured to lose structural integrity under the predetermined thermodynamic condition and thereby allow the distal movable member to move from a preactivation position to an activated position with respect to the distal base. The thermal trigger assembly also comprises a flexible connector having a proximal end and a distal end. The proximal end is connected to the proximal movable member, and the distal end is connected to the distal movable member. The thermally responsive element retains the distal movable member in the preactivation position with respect to the distal base and also retains the proximal movable member in the preactivation position with respect to the proximal base. Upon the loss of structural integrity by the thermally responsive element, a biasing force from the bias member causes a movement of the proximal movable member from the preactivation position of the proximal movable member to the activated position of the proximal movable member.

In another aspect, in a preferred embodiment of the present invention, a dry sprinkler device comprises a fire protection system component configured to be actuated by a mechanical movement. and an activation component. The activation component includes a proximal base having a proximal end and a distal end with respect to the fire protection system component. A proximal movable member is movable with respect to the proximal base. A bias member is located with respect to the proximal base to bias the proximal movable member from a preactivation position to an activated position with respect to the proximal base. The activated position is located proximally of the preactivation position. The activation component also comprises a distal base, a distal movable member, and a thermally responsive element. The thermally responsive element is retained by the distal base until a predetermined thermodynamic condition occurs. The thermally responsive element is configured to lose structural integrity under the predetermined thermodynamic condition and thereby allow the distal movable member to move from a preactivation position to an activated position with respect to the distal base. The activation component also comprises a flexible connector has a proximal end and a distal end. The proximal end is connected to the proximal movable member and the distal end connected to the distal movable member. The thermally responsive element retains the distal movable member in the preactivation position with respect to the distal base also retains the proximal movable member in the preactivation position with respect to the proximal base. Upon the loss of structural integrity by the thermally responsive element, a biasing force from the bias member causes a movement of the proximal movable member from the preactivation position of the proximal movable member to the activated position of the proximal movable member.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings:

FIG. 9 is an enlarged partial elevational sectional view of an alternative embodiment of the proximal base of the device of FIG. 2, shown in the activated position;

FIG. 10 is a partial perspective view of a bracket and a distal base secured to a conduit in accordance with a preferred embodiment of the invention.

DETAILED DESCRIPTION OF THE INVENTION

Figure 1:
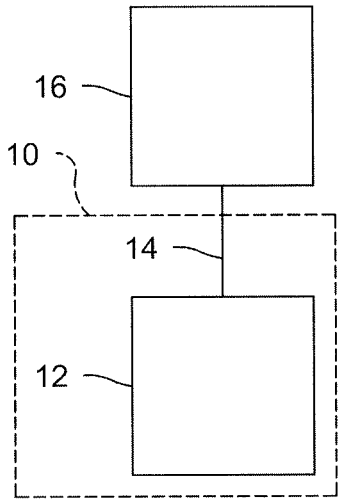
FIG. 1 is a schematic diagram of a dry sprinkler device including a thermal trigger assembly configured for remote mechanical actuation of another fire protection system component in accordance with a preferred embodiment of the invention.

Certain terminology is used in the following description for convenience only and is not limiting. The words "lower," "bottom," "upper," "top," "front," "back," and "rear" designate directions in the drawings to which reference is made. The words "inwardly" and "outwardly" refer to directions toward and away from, respectively, the geometric center of the component being discussed, and designated parts thereof, in accordance with the present disclosure. "Proximal" and "distal" refer to directions generally toward and away from, respectively, the fire protection system component being triggered by the thermal trigger assembly, unless the context indicates otherwise. Unless specifically set forth herein, the terms "a," "an," and "the" are not limited to one element, but instead should be read as meaning "at least one." The terminology includes the words noted above, derivatives thereof, and words of similar import.

As shown in FIG. 1, in a block diagram of a preferred embodiment of the present invention, a thermal trigger assembly 10 is configured for remote mechanical actuation of another fire protection system component 16. The thermal trigger assembly 10 comprises an activation component 12 and a flexible connector 14 configured to allow the activation component 12 to remotely mechanically actuate the other fire protection system component 16, which in some preferred embodiments (discussed below) is a valve for discharging water into one or more sprinklers, a switch or a relay having a throw, a magnet (such as a Reed switch or relay) or an equivalent that can be mechanically moved, or another type of fire-protection system device actuatable by a mechanical input. As will be described below, the activation component 12 and the flexible connector 14 are not necessarily distributed in space in the same manner as they are depicted in the block diagram of FIG. 1.

Figure 5:
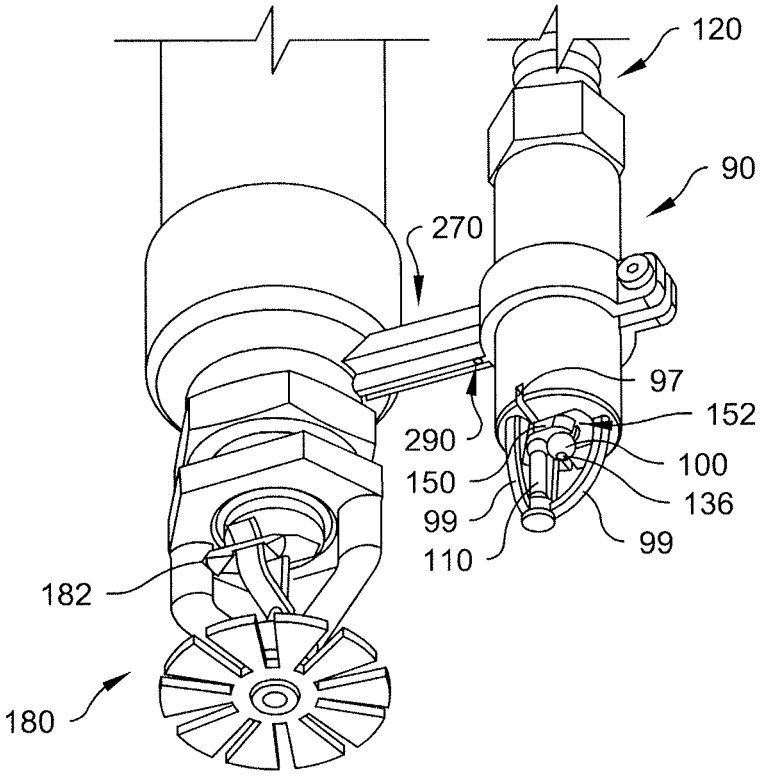
FIG. 5 is an enlarged partial perspective view of the sprinkler head and the distal base of the device of FIG. 2.
Figure 6:
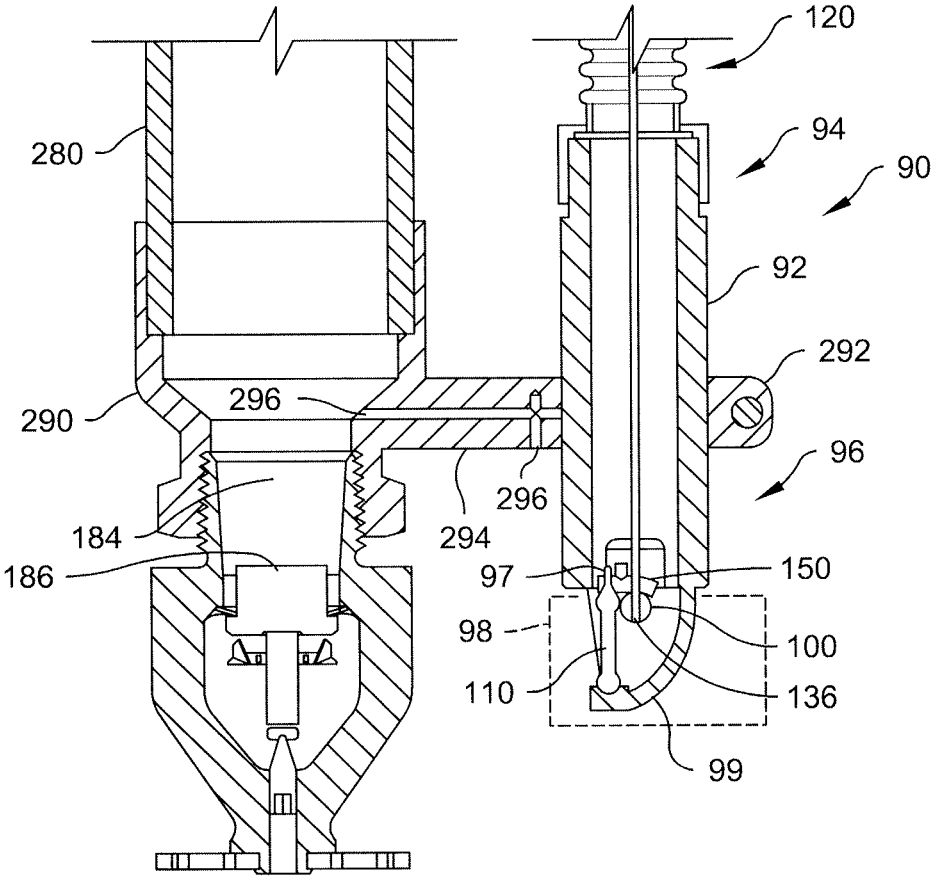
FIG. 6 is an enlarged partial elevational sectional view of the sprinkler head and the distal base of FIG. 5.
Figure 7:
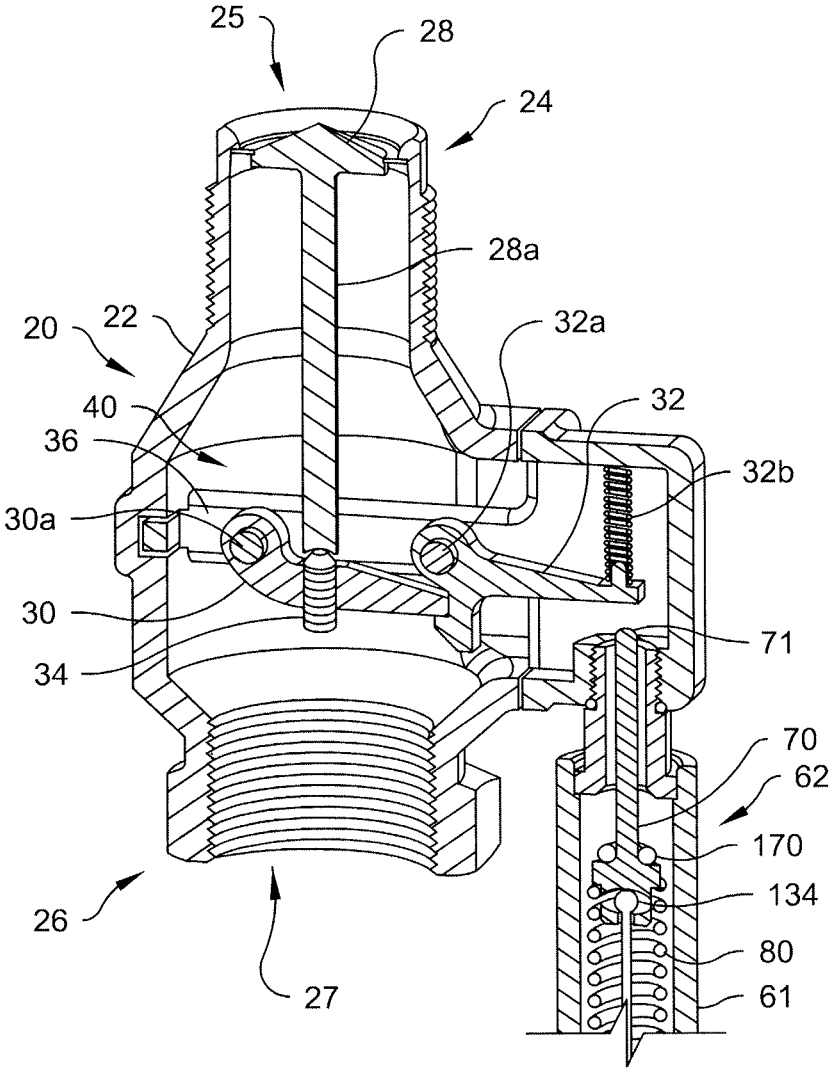
FIG. 7 is an enlarged partial elevational sectional view of the valve component and the proximal base of the device of FIG. 2, shown in the preactivation position.
Figure 8:
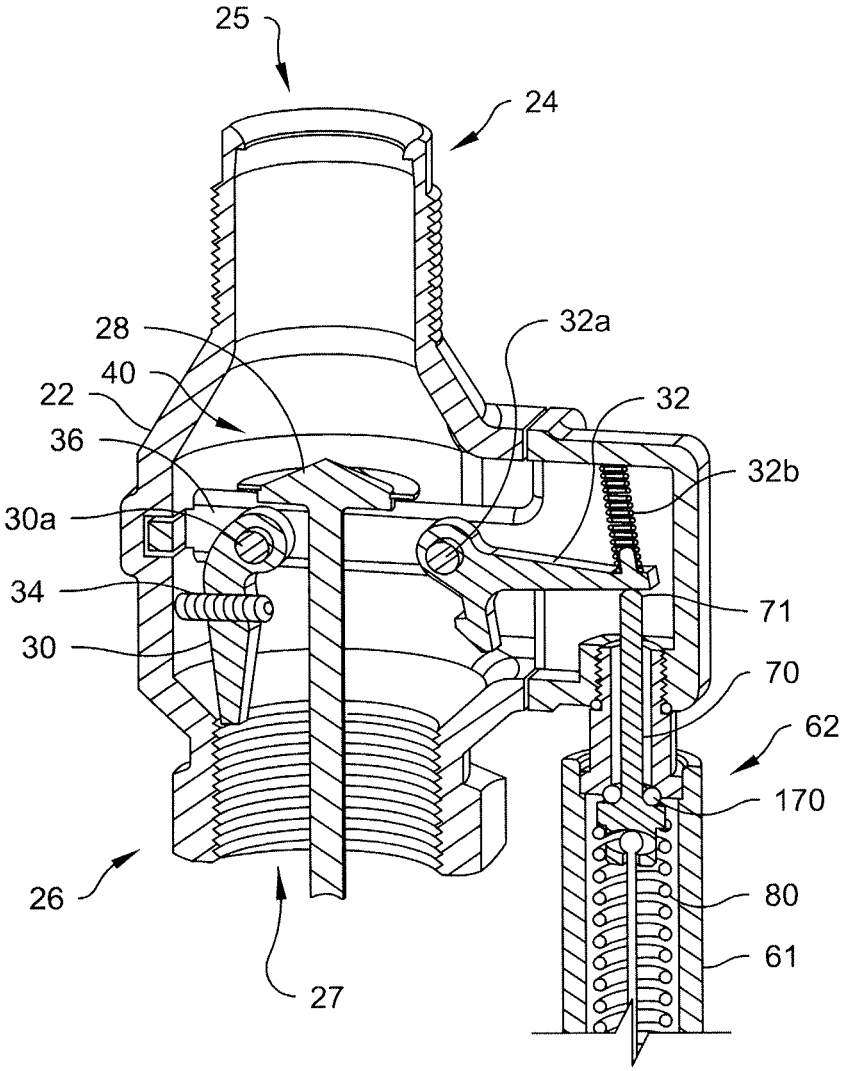
FIG. 8 is an enlarged partial elevational sectional view of the valve component and the proximal base of FIG. 7, shown in the activated position.

In another preferred embodiment, as shown in FIGS. 2 through 8, a dry sprinkler device includes a thermal trigger assembly configured for remote mechanical configuration of another fire protection system component, which in FIGS. 2-4, 7, and 8 takes the form of a valve 20. The thermal trigger assembly comprises an activation component 50 including a proximal base 60 having a body 61, proximal end 62, and a distal end 64 with respect to the other fire system component (the valve 20). In some embodiments, a nut 63 at the distal end 64 of the body 61 has a notched fitting 63*a* for attaching a flexible connector 120 (described below), and the nut engages the threads 64*a*. A proximal movable member 70 is movable with respect to the proximal base 60. A bias member, best seen in FIGS. 7 and 8, is shown as a coil spring 80. A "bias member" as discussed herein could alternatively take the form of other devices capable of supplying a restorative force in response to a displacement—for example, an air spring or a leaf spring. The bias member (the coil spring 80) is located with respect to the proximal base 60 to bias the proximal movable member 70 from a preactivation position, shown in FIG. 7, to an activated position, shown in FIG. 8, with respect to the proximal base 60.

The activated position is located proximally of the preactivation position, so that a movement of the proximal movable member 70 from the preactivation position to the activated position with respect to the proximal base 60 is a movement generally proximally that is, toward the other fire protection component, the valve 20 (upwardly when viewing FIG. 8). Note that in the preactivation position, shown in FIG. 7, there is a gap between the proximal end 71 of the proximal moveable member and the latch 32. In the activated position, shown in FIG. 8, the proximal end 71 of the proximal moveable member 70 is in contact with the latch 32. In some embodiments, the proximal end 70*a* of the proximal moveable member makes a forcible impact with a portion of the other fire protection component—for example, the latch 32 of the valve 20.

The thermal trigger assembly also comprises a distal base 90, a distal movable member in the form of a pull 100, and a thermally responsive element 110, which in a some embodiments is an alcohol-filled glass bulb, is retained by the distal base 90 until a predetermined thermodynamic condition occurs or is reached. Alternatively, in certain embodiments the distal movable member could take the form of an end portion of the flexible connector 120.

The thermally responsive element 110 is configured to lose structural integrity under the predetermined thermodynamic condition and thereby allow the distal movable member 100 to move from a preactivation position to an activated position located generally proximally (that is, toward the valve 20) with respect to the distal base 90. Referring to FIG. 6, the distal base 90 comprises a body 92 with a proximal end 94, a distal end 96, and an extension 98 (lying within the dashed box in FIG. 6) extending distally from the distal end 96, with the extension 98 including arms 99 supporting the thermally responsive element 110. The distal base 90 also includes a fulcrum 97 supported by the distal base 90, also supported in the present embodiment by the extension 98.

Referring again to FIGS. 2-8, the thermal trigger assembly also comprises the flexible connector 120 having a proximal end 122 and a distal end 124, the proximal end 122 being connected to the proximal movable member 70, and the distal end 124 being connected to the distal movable member 100. The connections between the flexible connector 120 and other components may be direct or maybe indirect, with intervening connecting components disposed between the flexible connector 120 and, for example, the proximal movable member 70. The thermally responsive element 110 retaining the distal movable member, the pull 100, in the preactivation position with respect to the distal base 90 also retains the proximal movable member 70 in the preactivation position with respect to the proximal base 60. Upon the loss of structural integrity by the thermally responsive element 110, a biasing force from the bias member (the coil spring 80) causes a movement of the proximal movable member 70 from the preactivation position of the proximal movable member 70 (FIG. 7) to the activated position of the proximal movable member 70 (FIG. 8).

The flexible connector 120 includes a flexible hollow outer cable housing 126 with a proximal housing end 128 configured to be stationarily connected with respect to the proximal base 60 and a distal housing end 130 configured to be stationarily connected with respect to the distal base 90. The flexible outer cable housing 126 may include at least one joint 126*a* joining two or more portions thereof. The flexible connector 120 also includes a flexible inner member 132 located inside the flexible hollow outer cable housing 126 for movement within the flexible outer cable housing 126 and having a proximal inner member end 134 (FIG. 7)

and a distal inner member end 136 (FIG. 6), the proximal inner member end 134 stationarily connected with the proximal movable member 70, and the distal inner member end 136 being stationarily connected with the distal movable member, which in the exemplary embodiment is the pull 100. The distal movable member may, as an alternative to the pull 100, include other bodies engaged with the flexible connector 120, the other bodies having any convenient shape. More generally, the proximal inner member end 134 is configured for a mechanical connection with the latch 32 for removing the support provided by the latch 32 from the seal member 28, thereby permitting a fluid to flow through the fluid passageway 40 of the valve 20.

Referring now to FIGS. 5 and 6, a platform 150 is engaged with the fulcrum 97, the distal movable member 100, and the thermally responsive element 110 such the distal movable member 100 and the thermally responsive element 110 restrain the platform 150 on the fulcrum 97. Although the platform 150 is illustrated as a relatively flat plate, generally a platform 150 according to the invention can take any shape that is supportable on the fulcrum 97 and that accommodates the necessary engagement of the thermally responsive element 110 and the distal movable member 100.

Upon the loss of structural integrity of the thermally responsive element 110 (due to the occurrence of a thermodynamic condition), the platform 150 pivots about the fulcrum 97 as a result of force from the bias member (the coil spring 80) transmitted by the flexible connector 120, allowing the distal movable member 100 to move to the activated position with respect to the distal base 90. In a preferred embodiment, as shown in FIGS. 5 and 6, the distal movable member takes the form of a pull 100 attached to the distal inner member end 136 of the flexible connector 120, and the platform 150 has a notch 152 for engaging the pull 100.

Figure 4:
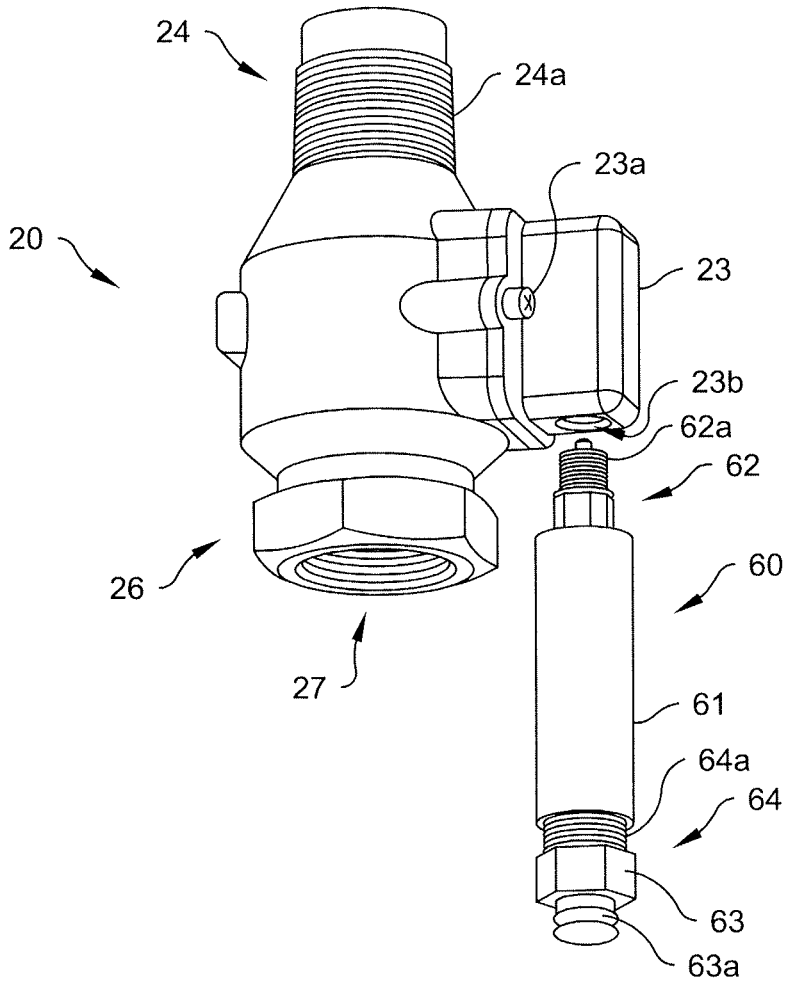
FIG. 4 is an enlarged and partially exploded perspective view of the valve component and the proximal base of the device of FIG. 2.

In an exemplary embodiment, as shown in FIGS. 4, 7 and 8, the valve 20 has a body 22 with an inlet 25 located at an inlet end 24, at least one outlet 27 located at an outlet end 26, and a fluid passageway 40 between the inlet 25 and the outlet 27. The inlet end 24 has screw threads 24*a* for attachment to a fluid source. The body 22 includes a removable cover 23 (FIG. 4) attached by screws 23*a* (one is shown). The removable cover has a threaded opening 23*b* for attaching the proximal base 60 at the proximal end 62 via threads 62*a*. Note that in an alternative embodiment, the valve 20 may have additional outlets (not shown) in fluid communication with the fluid passageway 40. A seal member 28 is supportable across the passageway 40 to close the passageway 40 by a lever 30, which is pivotally mounted by means of a lever pivot 30*a* located on a cross-member 36. The lever 30 is retained in a sealing position by a latch 32 engaged with the lever 30. The proximal inner member end 134 is configured to engage the latch 32 for movement of the latch 32 with respect to the lever 30 by a movement of the proximal inner member end 134 in the proximal direction in the activation position of FIG. 8. The latch 32 is supported by a latch pivot 32*a* located on the cross-member 36. A latch bias member, here a latch spring 32*b* acting in compression, retains the latch 32 in position supporting the lever 30 when in the preactivation position of FIG. 7. Optionally an adjustment screw 34 threadedly engages the lever 30 and a portion shaft portion 28*a*, which supports the seal member 28, with the combination providing a mechanism to adjust the engagement of the seal member 28 with the inlet 25. More generally, the proximal inner member end 134 of the flexible connector 120 is configured for engagement with the latch 32, either through direct contact or acting through intervening components, for removing the support provided by the latch 32 from the seal member 28 so that the seal member 28 moves away from the inlet 28 of the valve 20, thereby permitting a fluid to flow through the fluid passageway 40 (see FIG. 8).

Referring to FIG. 8, the proximal movable member 70 in the activated position is sealingly engaged with the proximal base 60 by the seal 170.

Alternatively, referring to FIG. 9, the seal 170 is omitted, and the proximal movable member 70 comprises a weephole 72 permitting fluid communication between a proximal portion 66 of the body 61 of the proximal base 60 with respect to the proximal movable member 70, and a distal portion 68 of the body 61 of the proximal base 60 with respect to the proximal movable member 70. Referring again to FIGS. 2-8, it is advantageous for the proximal movable member 70 to sealingly engage the proximal base 60 where the activation component 50 is used to control the valve 20 for permitting water flow to a sprinkler head 180, which remains closed until a second thermally responsive element 182 of the sprinkler head 180 (see FIG. 2) loses structural integrity under a predetermined thermodynamic condition. The sprinkler head 180 may include any of the wide variety of sprinkler heads currently common in the art, or any other type of water-discharge device for delivering water or other fluid onto a fire, and may include both open sprinkler heads and sprinkler heads containing plugs or other mechanisms for blocking and permitting fluid flow. This combination of components creates a system in which water flows through the sprinkler head 180 only if both the thermally responsive element 110 of the distal base 90 and the thermally responsive element, depicted as a fusible member 182, of the sprinkler head 180 are both activated. If the thermally responsive element 110 alone loses structural integrity, the valve 20 is opened, but water cannot flow through the sprinkler head 180; moreover, the sealing engagement of the proximal movable member 70 with the proximal base 60 prevents or minimizes water flow through the proximal base 60.

In the embodiment of FIG. 9, a weephole passage 72 of the proximal movable member 70 permits a small amount of water to flow through the proximal base 60 so that the triggering of the valve 20 alone, without the triggering of the sprinkler head 180, is more easily detected because water leaks through the weephole passage 72, eventually leaking from the activation component 50, with water becoming detectable in the vicinity of the distal base 90.

Referring to FIG. 10, a bracket 270 according to an exemplary embodiment of the invention supports a distal base 90 on a conduit 280.

Figure 11:
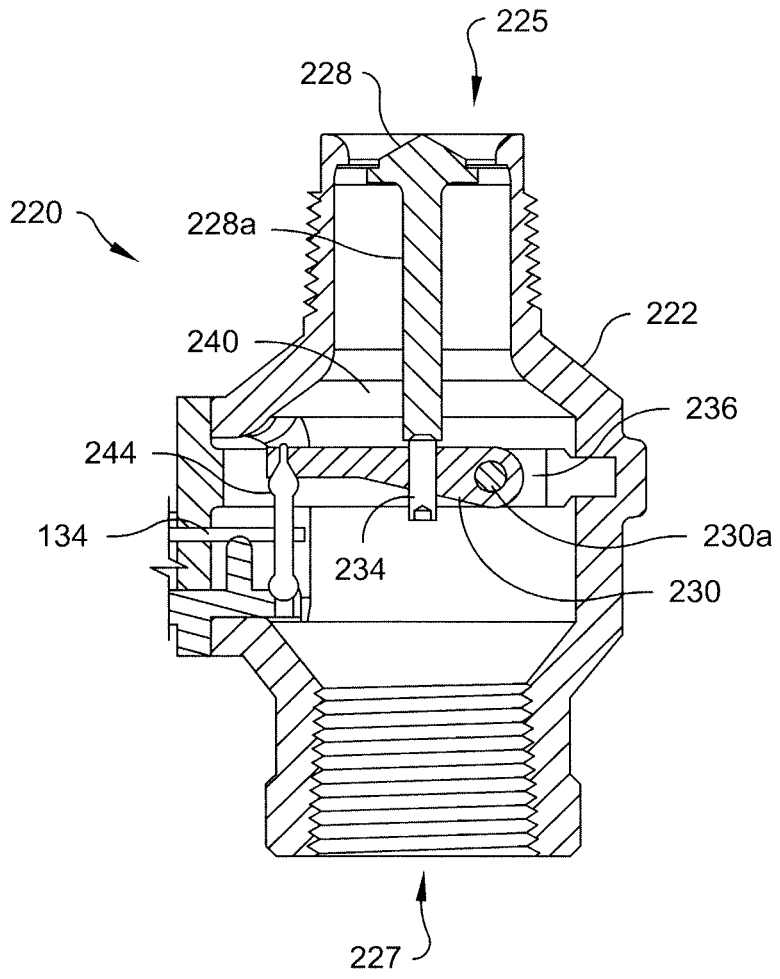
FIG. 11 an enlarged partial elevational sectional view of a valve component in accordance with a preferred embodiment of the invention, shown in the preactivation position.

In an alternative embodiment, shown in FIG. 11, the other fire component 20 may take the form of a valve 220, which is similar in many respects to the valve 20. The valve 220 has a body 222 with an inlet 225, an outlet 227, and a fluid passageway 240 between the inlet 225 and the outlet 227. Note that in an alternative embodiment, the valve 220 may have additional outlets (not shown) in fluid communication with the fluid passageway 240. A seal member 228 is supportable across the passageway 240 to close the passageway 240 by a pivotally mounted lever 230, the lever 230 being retained in a sealing position by a frangible support in the form of a glass bulb 244 engaged with the lever 230 until a movement of the flexible connector, the proximal inner member end 134 of the flexible connector being shown in FIG. 11, causes a collapse of the glass bulb 244. In the embodiment shown, the proximal inner member end 122 causes the collapse by transmitting a force to the glass bulb 244, and the proximal movable member takes the form of the proximal inner member end 134 of the flexible connector. The lever 230 is pivotally supported on a cross-member 236 by a lever pivot 230*a* located on a cross-member 236. Optionally an adjustment screw 234 threadedly engages the lever 230 and a shaft portion 228*a*, which in turn supports the seal member 228, with the combination providing a mechanism to adjust the engagement of the seal member 228 with the inlet 225. More generally, the proximal inner member end 134 of the flexible connector 120 is configured for engagement, either through direct contact or with intervening components, with the glass bulb 244 or other frangible support for removing the support from the seal member 228, thereby permitting a fluid to flow through the passageway 240.

Figure 2:
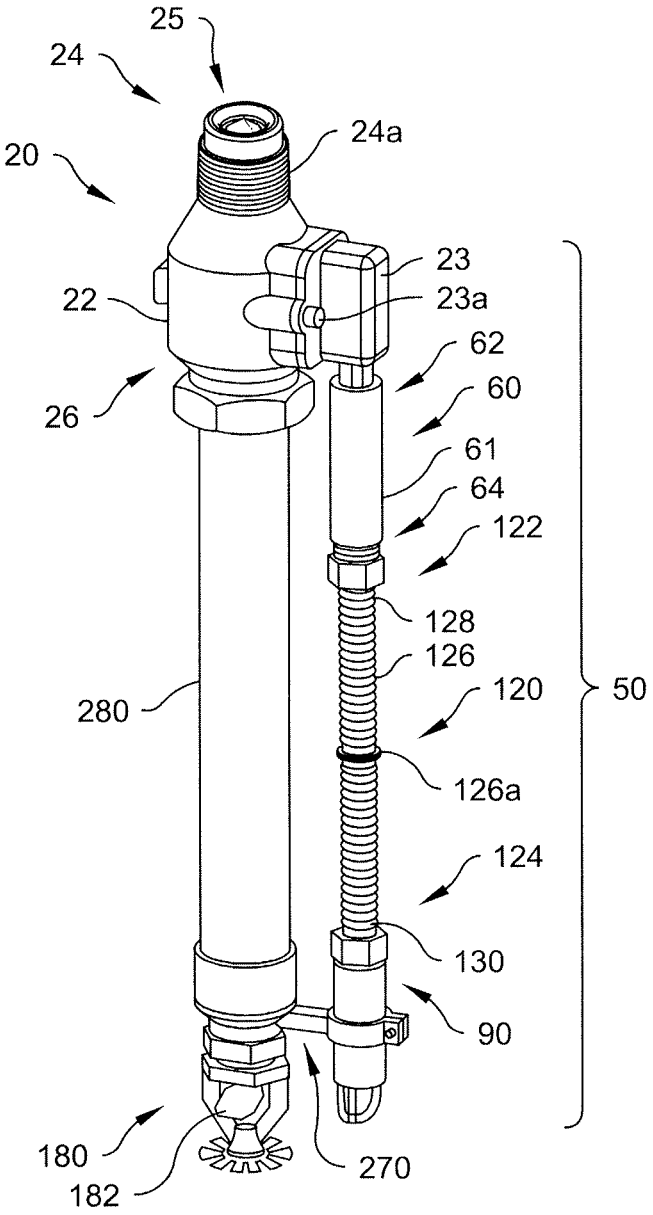
FIG. 2 is a perspective view of a dry sprinkler device including a fire protection system component activated by an activation component in accordance with a preferred embodiment of the invention.
Figure 3:
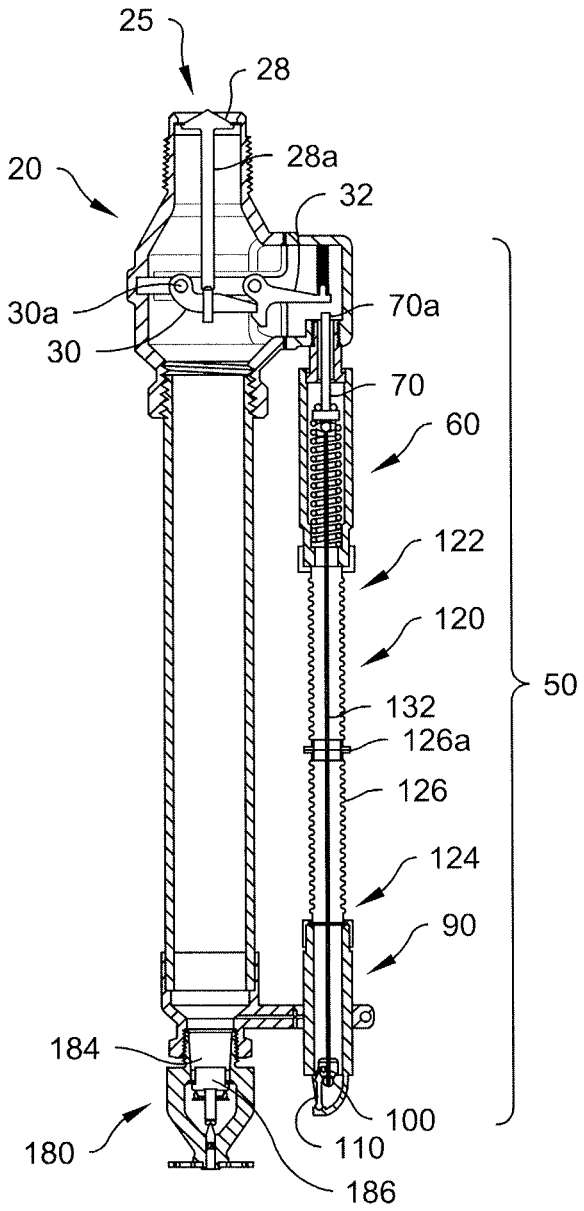
FIG. 3 is an elevational sectional view of the dry sprinkler device of FIG. 2.

In another alternative embodiment (not shown), the flexible inner member may be run, with or without a flexible outer cable housing, through the conduit 280 rather than outside the conduit as shown in FIGS. 2-8, with the distal base 90 in the alternative embodiment located in or near the location occupied by the sprinkler head 180 in FIGS. 2, 3, and 5, or by the reducer 290 in FIG. 6.

Referring again to FIGS. 2-8, the dry sprinkler device according to a preferred embodiment of the invention further comprises a conduit 280 in fluid communication with one of the at least one outlet 27 of the valve 20. The dry sprinkler device further comprises a water distribution device in the form of the sprinkler head 180 in fluid communication with the conduit 280, the sprinkler head 180 comprising an inlet 184 and an outlet sealed with an outlet plug 186 retained in a sealing position by a second thermally responsive element, which in the illustrated embodiment is a fusible member 182, but which may take the form of an alcohol-filled bulb, or any suitable form of thermally responsive element. The second thermally responsive element is configured to lose structural integrity under the occurrence of the predetermined thermodynamic condition and thereby allow a fluid to flow from the inlet 184 and through the outlet of the sprinkler head 180. Note that the predetermined thermodynamic condition selected for failure of the second thermally responsive element may be, but need not be, a different predetermined thermodynamic condition from the condition selected for the thermally responsive element 110 of the distal base 90.

Referring to FIG. 6, in a presently preferred embodiment, a dry sprinkler device comprises a reducer 290 and a bracket 292 having an outer surface 294, the bracket 292 being attached to the reducer 290. The attachment of the bracket 292 to the reducer 290 may optionally include the formation of the bracket 290 integrally with the reducer 290. In a preferred embodiment a weephole passage 296 is located proximally of the sealing member (the outlet plug 186) of the sprinkler head 180, the weephole passage 296 being in fluid communication with the conduit 280 and the outer surface 294 of the bracket 292, which outer surface 294 is a portion of the outer surface of the dry sprinkler device. Referring to FIGS. 2-8, the weephole passage 296 of the bracket 290 permits a small amount of water to flow through the bracket 290 so that the triggering of the valve 20 alone, without the triggering of the sprinkler head 180, is more easily detected because water leaks through the weephole passage 296 onto the outer surface 294 of the bracket 292.

In embodiments of the present invention, movement of the proximal movable member 70 is caused by the bias member (the coil spring 80), which is located at the proximal end 122 of the flexible connector 120, near the valve 20 or another fire system component 16. This may result in more reliable operation than a configuration in which a bias member is located at the distal end 124 of the flexible connector 120 and must overcome any deformation of the flexible connector 120 in order to generate sufficient movement to actuate the valve 20 or other fire system component 16.

The ability to displace the activation component from the sprinkler head or other device being controlled permits the advantageous location of the activation component at an optimal location for fire identification and response, and permits placement of the connected sprinkler(s) at optimal location(s) for water distribution and/or coverage.

Another possible use of the devices of the present invention is the provision of fire protection in attics of wood construction and other combustible concealed areas without or with obstructions.

Many embodiments of the invention offer a number of possible sprinkler options that were heretofore not available or unlikely to pass fire tests for attic use. The activation component of the present inventive system can be located at the peak of a roof, or wherever is optimum for the detection of heat from a fire most quickly for most rapid activation, while the sprinkler head(s) connected with the activation component through a valve component can be located wherever provides the best protection or installation—at the peak, away from the peak and/or away from the pitch—to obtain optimum water distribution and/or to be located closer to any potential source of fire.

Certain embodiments of the present invention enable the installation of any and all types of conventional sprinkler heads (pendent and sidewall, as well as upright and standard spray) in such locations, albeit in an open configuration without a plug or thermally responsive element. The provision of the present invention further enables the development of other new concept spray distribution methods and sprinkler heads suitable for such application(s). Moreover, conventional automatic sprinkler heads are installable according to their maximum listed coverage areas (or at least greater than one-hundred and thirty square feet if their normal, listed coverage area exceeds one-hundred and thirty square feet) and without hydraulic demand penalties currently imposed on conventional automatic sprinklers used in attics and other combustible concealed installations. Open sprinkler heads connected to a valve component of the present invention are also able to be pitched from the vertical to enhance their throw patterns, if necessary or desirable. Some embodiments of the invention also provide the opportunity to use less water than now required since embodiments of the invention provide optimum placement of the activation component for activation, as well as optimum placement of the spray sprinklers for fire protection because the functions are separated rather than being provided by a single device in the manner of a standard sprinkler.

These advantages are available in sprinkler systems installed in yet other "problem areas." So, certain embodiments of the present invention enable the installation of a dry attic sprinkler system while employing conventional automatic sprinkler heads that are open. The valve component can be located in a heated or other non-water-sensitive area spaced away from a cold or water-sensitive area where the activation component and heads can be located. Alternatively, water can be provided to a preaction valve assembly of the invention located in a cold or water sensitive area by the provision of a dry valve located upstream in a heated or non-water-sensitive area where the distance between the heated or non-water-sensitive area and the activation component is greater than the length of the flexible connector of the preaction valve assembly.

Finally, the provision of sprinkler heads fed by a valve component of the present invention permits the optimum location of the heads to attack a fire with a discharge of water sufficiently quickly and sufficiently close to the fire source to enable the passage of laboratory fire tests with delivered water densities of less than 0.1 gallons per minute per square foot of coverage area.

Another application is the fire protection of a truck loading dock that is under freezing conditions. Certain embodiments of the thermal trigger assembly of the present invention can replace a very expensive and complicated dry sprinkler system by allowing the use of existing approved open conventional sprinklers installed in the freezing area and installing the valve component in a heated area. This concept allows the reduction of ordinary hazard water densities to be lowered to light hazard requirements (over 50% less water) because of the speed and strategic positioning allowed by embodiments of the invention.

Being able to install any conventional automatic sprinkler head into a dry sprinkler device is itself a significant advantage. In addition to specific lengths, installers of conventional dry sprinkler systems have to specify other characteristics to order conventional dry sprinklers, including orientation (sidewall, upright or pendent and, if pendent, exposed, recessed or hidden), operating temperature, orifice size, finish and/or color. There are literally hundreds if not thousands of different conventional automatic sprinkler heads available from a variety of manufacturers that can be used, off the shelf, with valve components of the present invention to satisfy the thousands of potential combinations of these characteristics. Since only the valve components of the dry sprinkler devices of the present invention need approval from the recognized testing laboratories, it will be possible to install virtually any conventional automatic sprinkler head (open or plugged) with a valve component of the present invention, without limitation, to provide a dry system.

While there are literally hundreds if not thousands of possible different characteristic combinations for fire sprinklers, and many manufacturers willing to commercially supply those combinations in automatic sprinkler heads, they will only supply no more than about one-tenth of those characteristic combinations in dry sprinklers because each dry sprinkler must be tested independently by the approving labs as to operation, corrosion, and other performance characteristics. With each dry sprinkler costing more than $10,000 to be tested for approval by one of the recognized testing laboratories, manufacturers limit the varieties of dry sprinklers available because the market is not so big as to justify those approval expenses for the full range of available wet system sprinkler heads. Once approved, the preaction valve with thermal trigger assemblies of the present invention instantly allows virtually every laboratory-approved conventional automatic sprinkler head of every manufacture to be installed as a dry sprinkler device. This gives sprinkler system designers, building owners, and installers a virtually unlimited choice of sprinkler heads to use that will also save installation costs.

Since the valve components of the present invention can be mechanically tripped, they can be further be configured or accessorized to be separately remotely tripped, automatically or on demand.

Thermal trigger assemblies of the present invention can be configured to automatically trip at a temperature below, above, or equal to the rated temperature of the connected automatic (i.e. plugged) sprinkler head(s) by selection of the operating temperature of the thermally responsive element of the activation component to be lower or higher compared to that of the plugged sprinkler head. Thus, it is possible to preload a sprinkler head with water prior to activation, if desired, or delay loading of the sprinkler head until after it has opened.

When used to provide a two-step activation, thermal trigger assemblies of the present invention also give superior protection against vandalism or accidental damage, false trips or faulty sprinklers, and water damage—a major concern of both insurance companies and building owners. If a sprinkler is damaged prior to normal activation—for example, a bulb or other thermally responsive element breaks or is accidentally broken, or is defective (i.e. permits a leak)—no water will be released since the "independent" activation component of the present invention would not be triggered by damage to the sprinkler. Not only does this prevent water damage from unintended activation, it allows immediate field repair without removing the system from protective service and without having to wait for a factory manufactured replacement assembly. The system can be fully repaired, in the field, like a conventional wet system. (Maintaining an active system during head repairs has been notoriously very expensive, with sophisticated equipment required.)

If the thermal trigger assembly of a system with automatic (i.e. plugged) sprinkler heads is configured to open the valve component before sprinkler activation, fire protection is improved because there is no air to escape before the water flows from the sprinkler heads. The valve component prefills the sprinkler heads before conditions reach the activation temperature of the sprinkler heads.

A preaction valve with thermal trigger assembly of the present invention potentially allows plastic piping to be used as drops in areas that would have normally required dry sprinklers, provided that the valve component can be located in an area protected from and/or otherwise not subjected to freezing temperatures. This represents a tremendous savings in installation time and costs, particularly in those residential and light hazard systems otherwise amenable to plastic pipe installation throughout. The assemblies can be configured by selection of the thermally responsive elements to operate at a temperature above that at which the thermally responsive elements used in any automatic (i.e. plugged) sprinklers activate to assure there is no water inside the drop or pressurization of the drop until the thermally responsive elements of both the activation component and the sprinkler have reached their respective activation temperatures.

If the activation component 12 trips from breakage of the responsive element 110 or its equivalent, but the automatic (i.e. plugged) sprinkler 180 does not activate, the exposed portion of the activation component—for example, the distal base 90—will provide a visual indication below the ceiling that the activation component has tripped and that water is in a potentially freezing area, in addition to the indication provided by leakage through one or more weephole passages 72, 296, as described above. If the sprinkler leaks, dripping of water will provide a secondary indication of caution that the drop pipe is full of water and should be serviced.

In addition to providing a very economical alternative to compressed gas and antifreeze "dry" sprinklers, thermal trigger assemblies of the present invention can further present the possibility of economical dry residential sprinkler systems, with two-stage operation providing added security from damage for the property owner.

It will be appreciated by those skilled in the art that changes could be made to the embodiments described above without departing from the broad inventive concept thereof. It is understood, therefore, that this disclosure is not limited to the particular embodiments disclosed, but it is intended to cover modifications within the spirit and scope of the present disclosure as defined by the appended claims.

We claim:

1. A thermal trigger assembly configured for remote mechanical actuation of a fire protection system component, the thermal trigger assembly comprising:

an activation component including a proximal base having a proximal end and a distal end with respect to the fire protection system component, a proximal movable member, the proximal movable member being movable with respect to the proximal base, a distal base, the distal base being located farther from the fire protection system component than the proximal base, a distal movable member, a bias member located with respect to the proximal base to bias the proximal movable member from a preactivation position to an activated position with respect to the proximal base, the activated position being located upstream with respect to the preactivation position, a thermally responsive element retained by the distal base until a predetermined thermodynamic condition occurs, the thermally responsive element being configured to lose structural integrity under the predetermined thermodynamic condition and thereby allow the distal movable member to move from the preactivation position to the activated position with respect to the distal base, and a flexible connector having a proximal end and a distal end, the proximal end connected to the proximal movable member and the distal end connected to the distal movable member, such that the thermally responsive element retains the distal movable member in the preactivation position with respect to the distal base and also retains the proximal movable member in the preactivation position with respect to the proximal base, and such that upon the loss of structural integrity by the thermally responsive element, a biasing force from the bias member causes a movement of the proximal movable member from the preactivation position of the proximal movable member to the activated position of the proximal movable member.

2. The thermal trigger assembly of claim 1, wherein the flexible connector comprises:

a flexible hollow outer cable housing with a proximal housing end configured to be stationarily connected with respect to the proximal base and a distal housing end configured to be stationarily connected with respect to the distal base, and a flexible inner member located inside the flexible hollow outer cable housing for movement within the flexible outer cable housing and having a proximal inner member end and a distal inner member end, the proximal inner member end being stationarily connected with the proximal movable member and the distal inner member end being stationarily connected with the distal movable member.

3. The thermal trigger assembly of claim 2, wherein the fire protection component is a valve having a body, an open state, a closed state, an annular seal, a shaft configured to support the annular seal in the closed state, and a support assembly configured to support the shaft in the closed state, the support assembly comprising a lever supporting the shaft, wherein the proximal movable member is operatively connected to the support assembly such that movement of the proximal movable member acts on the support assembly such that the lever moves and the valve changes from the closed state to the open state.

4. The thermal trigger assembly of claim 3, wherein the proximal movable member causes the movement of the lever by releasing a latch from the lever.

5. The thermal trigger assembly of claim 3, wherein the proximal movable member causes the movement of the lever by transmitting a compressive force upon a component other than the latch.

6. The thermal trigger assembly of claim 3, wherein the support assembly further comprises a screw oriented substantially collinear with the shaft, the screw acting upon the support assembly and the shaft, the screw applying a force to the annular seal to maintain the valve in the closed state.

7. The thermal trigger assembly of claim 3, wherein the body of the valve has an inlet and an outlet and a fluid passageway connecting the inlet with the outlet, and the combination further comprises at least one water distribution device fluidly coupled with the outlet.

8. The thermal trigger assembly of claim 7, wherein a pipe connects the at least one water distribution device to the outlet.

9. The thermal trigger assembly of claim 8, wherein the inlet is fluidly connected to a water supply line.

10. The thermal trigger assembly of claim 1, wherein the fire protection component is a valve having a body, an open state, a closed state, an annular seal, a shaft configured to support the annular seal in the closed state, and a support assembly configured to support the shaft in the closed state, the support assembly comprising a lever supporting the shaft, wherein the lever is retained in a sealing position by a frangible support engaged with the lever until a movement of the proximal movable member causes a collapse of the frangible support.

11. The thermal trigger assembly of claim 10, wherein the flexible connector comprises:

a flexible hollow outer cable housing with a proximal housing end configured to be stationarily connected with respect to the proximal base and a distal housing end configured to be stationarily connected with respect to the distal base, and a flexible inner member located inside the flexible hollow outer cable housing for movement within the flexible outer cable housing and having a proximal inner member end and a distal inner member end, the proximal inner member end being stationarily connected with the proximal movable member and the distal inner member end being stationarily connected with the distal movable member, and wherein the proximal inner member end causes the collapse by transmitting a force to the frangible support.

12. The thermal trigger assembly of claim 11, wherein the force causing the collapse of the frangible element is a compressive force exerted by the proximal movable member.

13. The thermal trigger assembly of claim 10, wherein the support assembly further comprises a screw oriented substantially collinear with the shaft, the screw acting upon the support assembly and the shaft, the screw applying a force to the annular seal to maintain the valve in the closed state.

14. The thermal trigger assembly of claim 6, wherein the body of the valve has an inlet and an outlet and a fluid passageway connecting the inlet with the outlet, and the combination further comprises at least one water distribution device fluidly coupled with the outlet.

15. The thermal trigger assembly of claim 14, wherein a pipe connects the at least one water distribution device to the outlet.

16. The thermal trigger assembly of claim 15, wherein the inlet is fluidly connected to a water supply line.

17. The thermal trigger assembly of claim 1, wherein the proximal movable member in the activated position is sealingly engaged with the proximal base, and the proximal movable member comprises a weep hole passage permitting fluid communication between a proximal portion of the body of the proximal base with respect to the proximal movable member and a distal portion of the body of the proximal base with respect to the proximal movable member.

18. The thermal trigger assembly of claim 1, wherein the distal base comprises:

a body with a proximal end, a distal end, and an extension extending distally from the distal end, the extension supporting the thermally responsive element, a fulcrum supported by the body, a platform engaged with the fulcrum, the distal movable member, and the thermally responsive element such the distal movable member and the thermally responsive element restrain the platform on the fulcrum, and upon the loss of structural integrity of the thermally responsive element, the platform pivots about the fulcrum, allowing the distal movable member to move to the activated position with respect to the distal base.

19. The thermal trigger assembly of claim 18, wherein the distal movable member comprises a pull attached to the flexible connector, and the platform has a notch for engaging the pull.

20. A dry sprinkler device comprising:

a fire protection system component configured to be actuated by a mechanical movement;

an activation component including a proximal base having a proximal end and a distal end with respect to the fire protection system component, a proximal movable member, the proximal movable member being movable with respect to the proximal base, a distal base, the distal base being located farther from the fire protection system component than the proximal base, a distal movable member, a bias member located with respect to the proximal base to bias the proximal movable member from a preactivation position to an activated position with respect to the proximal base, the activated position being located toward a proximal direction with respect to the preactivation position, the proximal direction being oriented from the distal base toward the proximal base, a thermally responsive element retained by the distal base until a predetermined thermodynamic condition occurs, the thermally responsive element being configured to lose structural integrity under the predetermined thermodynamic condition and thereby allow the distal movable member to move from the preactivation position to the activated position with respect to the distal base, and a flexible connector having a proximal end and a distal end, the proximal end connected to the proximal movable member and the distal end connected to the distal movable member, such that the thermally responsive element retains the distal movable member in the preactivation position with respect to the distal base and also retains the proximal movable member in the preactivation position with respect to the proximal base, and such that upon the loss of structural integrity by the thermally responsive element, a biasing force from the bias member causes a movement of the proximal movable member from the preactivation position of the proximal movable member to the activated position of the proximal movable member, wherein the fire protection component is a valve having a body, an open state, a closed state, an annular seal, a shaft configured to support the annular seal in the closed state, and a support assembly configured to support the shaft in the closed state, the support assembly comprising a lever supporting the shaft, wherein the proximal movable member is operatively connected to the support assembly such that movement of the proximal movable member acts on the support assembly to move the lever such that the valve changes from the closed state to the open state.

21. The dry sprinkler assembly of claim 20, wherein the support assembly further comprises a screw oriented substantially collinear with the shaft, the screw acting upon the support assembly and the shaft, the screw applying a force to the annular seal to maintain the valve in the closed state.

22. The dry sprinkler assembly of claim 20, wherein the body of the valve has an inlet and an outlet and a fluid passageway connecting the inlet with the outlet, and the combination further comprises at least one water distribution device fluidly coupled with the outlet.

23. The dry sprinkler assembly of claim 22, wherein a pipe connects the at least one water distribution device to the outlet.

24. The dry sprinkler assembly of claim 23, wherein the inlet is fluidly connected to a water supply line.

25. A dry sprinkler device comprising:

a fire protection system component configured to be actuated by a mechanical movement;

an activation component including a proximal base having a proximal end and a distal end with respect to the fire protection system component, a proximal movable member, the proximal movable member being movable with respect to the proximal base, a distal base, the distal base being located farther from the fire protection system component than the proximal base, a distal movable member, a bias member located with respect to the proximal base to bias the proximal movable member from a preactivation position to an activated position with respect to the proximal base, the activated position being located toward a proximal direction with respect to the preactivation position, the proximal direction being oriented from the distal base toward the proximal base, a thermally responsive element retained by the distal base until a predetermined thermodynamic condition occurs, the thermally responsive element being configured to lose structural integrity under the predetermined thermodynamic condition and thereby allow the distal movable member to move from the preactivation position to the activated position with respect to the distal base, and a flexible connector having a proximal end and a distal end, the proximal end connected to the proximal movable member and the distal end connected to the distal movable member, such that the thermally responsive element retains the distal movable member in the preactivation position with respect to the distal base and also retains the proximal movable member in the preactivation position with respect to the proximal base, and such that upon the loss of structural integrity by the thermally responsive element, a biasing force from the bias member causes a movement of the proximal movable member from the preactivation position of the proximal movable member to the activated position of the proximal movable member, wherein the fire protection system component is a valve having a body with an inlet, at least one outlet, and a fluid passageway between the inlet and each outlet, wherein the dry sprinkler device further comprises:

a conduit in fluid communication with one of the at least one outlet of the valve, and a water distribution device in fluid communication with the conduit, the water distribution device comprising an inlet and an outlet connected by a passage, the passage being sealed by a sealing member retained in a sealing position by a second thermally responsive element, the second thermally responsive element configured to lose structural integrity under the predetermined thermodynamic condition and thereby allow a fluid to flow between the inlet and the outlet of the water distribution device.

26. The dry sprinkler device of claim 25, further comprising a weep hole passage located in the proximal direction with respect to the sealing member of the water distribution device, the weep hole passage being in fluid communication with the conduit and an outer surface of the dry sprinkler device.

27. The dry sprinkler device of claim 25, further comprising:

a bracket having an outer surface and being attached to the conduit; and a weep hole passage passing through at least a portion of the bracket, the weep hole passage being in fluid communication with the conduit and with the outer surface of the bracket.

* * * * *